United States Patent [19]

Dorius

[11] 4,137,904

[45] Feb. 6, 1979

[54] EXHAUST HOOD EMPLOYING A VENTURI SLOT

[75] Inventor: John O. Dorius, Glendale, Calif.

[73] Assignee: Elsters, Inc., Hollywood, Calif.

[21] Appl. No.: 800,444

[22] Filed: May 25, 1977

[51] Int. Cl.[2] ..... F21C 15/08; F23J 11/00

[52] U.S. Cl. ..... 126/299 D; 55/DIG. 36

[58] Field of Search ..... 126/299 D; 55/36

[56] References Cited

U.S. PATENT DOCUMENTS

| | | | |
|---|---|---|---|
| 3,457,850 | 7/1969 | Sweet et al. | 126/299 D |
| 3,664,255 | 5/1972 | Kuechler | 126/299 D |
| 3,978,777 | 9/1976 | Nett | 126/299 D |

*Primary Examiner*—Ronald C. Capossela

*Attorney, Agent, or Firm*—Spensley, Horn & Lubitz

[57] ABSTRACT

An exhaust hood may be fabricated which will reduce the rate of exhaust air quantities circulated through the exhaust hood and thereby reduce the quantity of make up air supplied to the exhaust hood from the conditioned space with a resultant energy savings. The exhaust hood may include a supply plenum, an exhaust duct and a partial pressure chamber coupled to the supply plenum. A partial pressure is formed within the partial pressure chamber which is provided with at least one venturi slot at its lower extremity. Typically, two venturi slots are employed to produce a partial pressure region exterior to the partial pressure chamber, which region is juxtapositioned to an inlet port provided in the exhaust duct.

6 Claims, 4 Drawing Figures

EXHAUST HOOD EMPLOYING A VENTURI SLOT

BACKGROUND OF THE INVENTION

1. Field of the Invention

The present invention relates to the field of air treatment and conditioning apparatus and in particular, relates to exhaust hoods employed over cooking surfaces.

2. Description of the Prior Art

Commercial cooking, washing, and other food preparation stations typically require some means for removal of smoke, grease, vapors or steam which tend to accumulate over the station. Accumulations of such gaseous matter and airborne particulate matter have been removed by prior art apparatus which were as simple as an exhaust duct coupled to a collecting canopy or as sophisticated as an exhaust hood with provisions for make-up air drawn from the environment, directed by appropriate means to an exhaust inlet port and discharged through an exhaust duct back to the environment. In such latter cases, smoke and vapors would rise by natural convection and become entrained in the flow of make up air between the supply plenum and the exhaust duct. However, more than merely the smoke and vapor rising from the heated surface would be entrained within the make-up air flow. Considerable amounts of air would be drawn from the surrounding spaces, entrained in the make-up air flow and discharged to the environment. As a result, it is characteristic of such prior art exhaust hoods that significant amounts of air would be taken from the conditioned space, lost to the environment and would have to be replaced by the overall air treatment and conditioning facilities in the structure. The energy used to heat, cool or condition the air would thus necessarily be sacrificed in order to obtain the proper evacuation over the cooking or washing station. The greater the amount of steam and vapors which would have to be removed, the greater would be the quantities of make-up air required to be circulated through the exhaust hood during a given interval. The greater the amount of make-up air circulated through the exhaust hood, the greater amount of space conditioned air which would also be entrained within the air flow. Thus, the amount of energy lost to the environment also increased.

What is needed then, is a design for an exhaust hood which can provide the necessary capacity to evacuate the hood and yet minimize the amount of space conditioned air surrounding the hood which is removed from the space and lost to the environment.

BRIEF SUMMARY OF THE INVENTION

The present invention is an apparatus comprising a supply plenum coupled to a source of air, an exhaust duct coupled to a sink of air, and a partial pressure chamber communicating with the supply plenum. The partial pressure chamber has at least one venturi slot defined on its periphery to form a low pressure region in the proximity of the venturi slot. By virtue of this combination, the rate of exhaust air quantity within the apparatus and the amount of air drawn into the apparatus from the surrounding conditioned space is decreased.

In one embodiment of the invention, the exhaust duct has an inlet port disposed in the proximity of the venturi slot. In another embodiment of the invention, the partial pressure chamber has two venturi slots, namely a first venturi slot disposed in the proximity of the inlet port of the exhaust duct and a second venturi slot disposed in the proximity of the cooking line corresponding to the cooking surface above which the apparatus is disposed.

Typically, the partial pressure chamber communicates with the supply plenum through a means for providing a differential pressure drop such as a plurality of apertures defined in a common wall between the supply plenum and the partial pressure chamber. The plurality of apertures may be linerally arranged and disposed in a substantially overlying relationship with respect to the first venturi slot to form a region of partial pressure within the partial pressure chamber and exterior to the partial pressure chamber in a region between the first and second venturi slots. In such a case, it may further be possible that the first venturi slot be disposed below the second venturi slot and set further back from the cooking line than the second venturi slot. These and other embodiments and advantages of the present invention may be better understood by referring to the detailed description of the preferred embodiments in light of the figures.

DETAILED DESCRIPTION OF THE PREFERRED EMBODIMENTS

The present invention includes an exhaust hood for use over a cooking surface which has a cooking line. The exhaust hood comprises: (1) a supply plenum coupled to a source of air; (2) an exhaust duct coupled to a sink of air and having an inlet port; and (3) a partial pressure chamber communicating with the supply plenum through a plurality of apertures oppositely disposed to a first slot defined in one of the walls of the partial pressure chamber. The first slot is juxtapositioned next to the inlet port of the exhaust duct. A second slot is also defined in one of the walls of the partial pressure chamber and is disposed substantially over the cooking line. The cooking line 13 is defined as one edge of cooking surface 12 over which edge access is provided to the cooking surface to personnel and usually divides the work area from the cooking apparatus. The structure of the present invention and its operation may be better understood by viewing FIG. 1.

Figure 1:
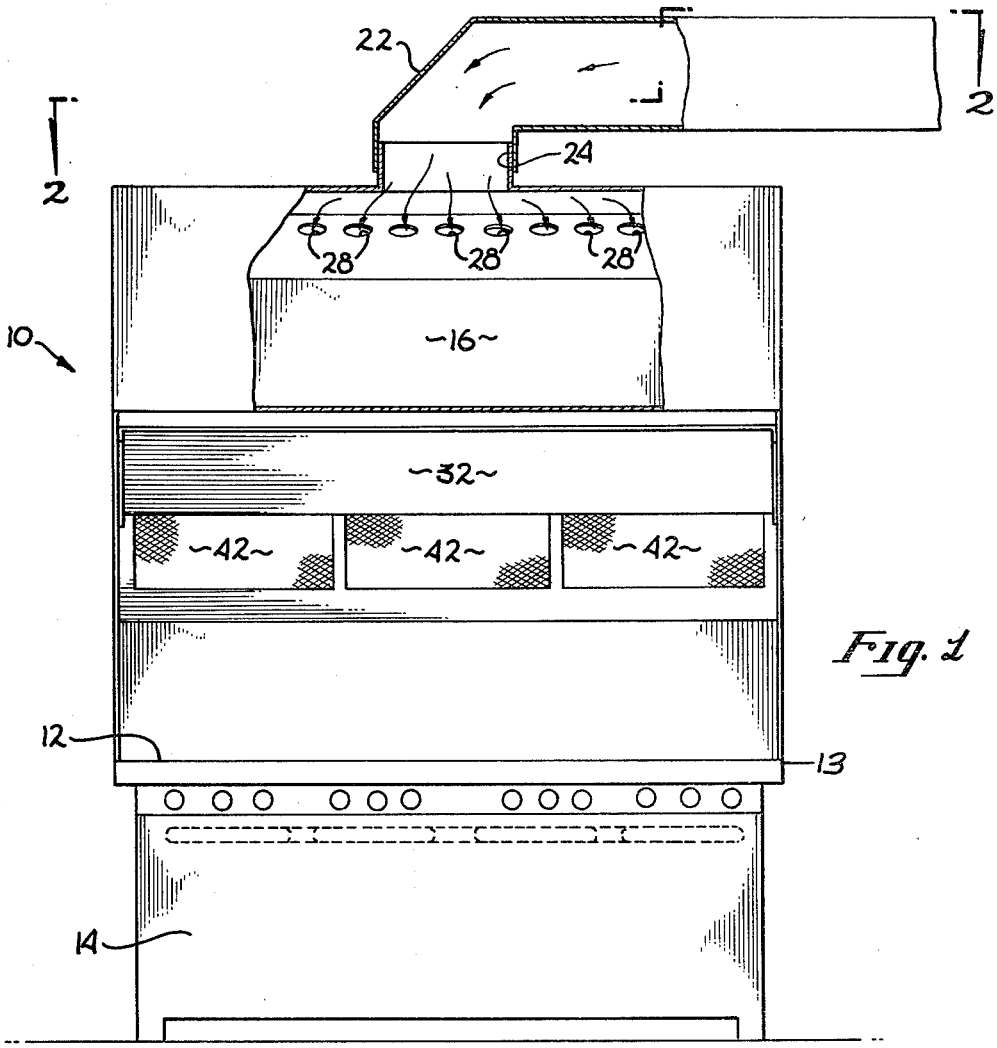
FIG. 1 is a front view of one embodiment of the present invention shown disposed over a conventional cooking surface.

FIG. 1 shows an apparatus 10 being used as an exhaust hood over a conventional cooking surface 12. Surface 12 represents the upper portion of a conventional grill 14. Although the present invention is shown in combination with cooking apparatus such as a grill, it must be expressly understood that it may be used in combination with any apparatus well known to the art above which it is desirable to remove the smoke, grease or vapors. Thus, it is expressly to be included that where appropriate, the present invention may appropriately be used within a dish or pot washing machine. Apparatus or hood 10 includes a supply plenum 16, a partial pressure chamber 18, and an exhaust duct 20 best shown in FIG. 3. Supply plenum 16 includes a chamber formed in the front portion of hood 10 and coupled by appropriate conduit or ductwork 22 to a source of air. Typically, such source of air includes a supply fan having an inlet communicating with the environment. However, it is also possible that other sources of air could be utilized, such as sources of tempered, conditioned, or recycled air. Thus, the air is drawn or forced through ductwork 22 through inlet 24 into supply plenum 16.

Figure 2:
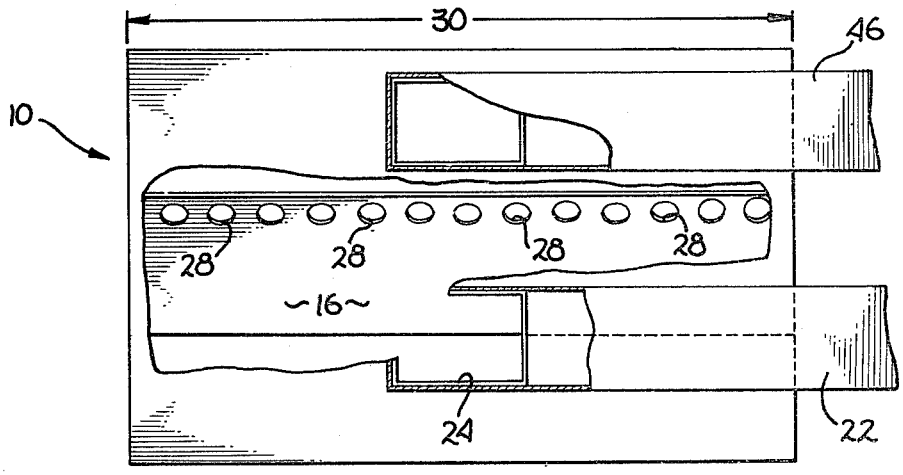
FIG. 2 is a plan view, partially cutaway, of the embodiment shown in FIG. 1.
Figure 3:
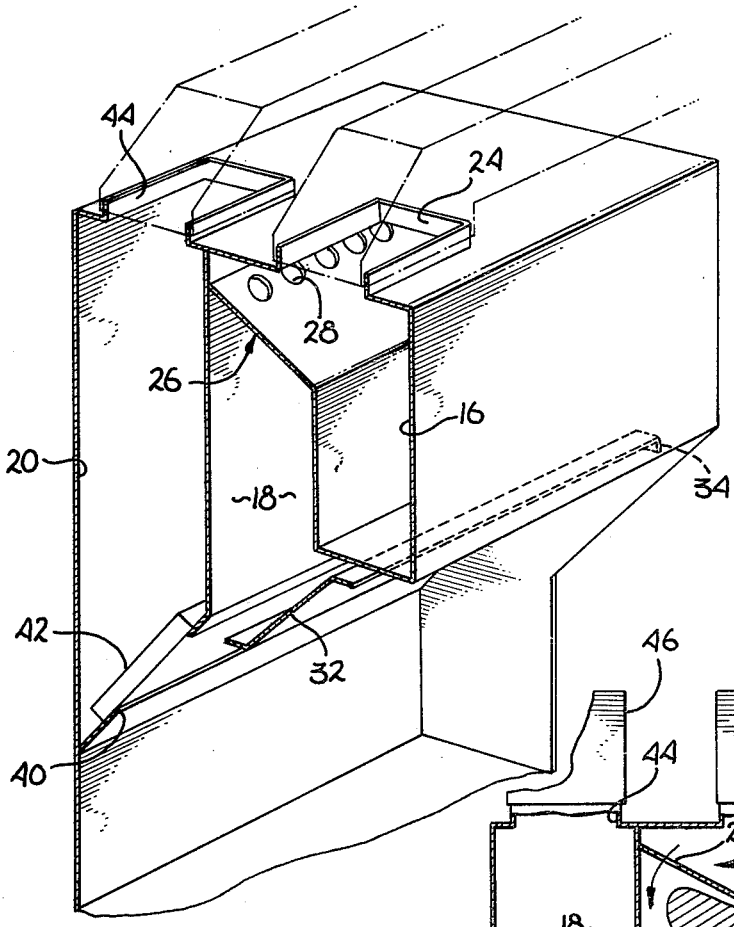
FIG. 3 is a perspective cross sectional view of the apparatus of FIG. 1 showing the relationship between the elements of the present invention.

Supply plenum 16 communicates with partial pressure chamber 18 by a means 26 for producing a differential pressure drop between supply plenum 16 and chamber 18. In the illustrated embodiment as shown in FIGS. 1, 2 and 3, means 26 includes a plurality of apertures 28 which provide the required pressure drop. The magnitude of the pressure drop can be controlled by the number, size and shape of the plurality of apertures 28 provided in a common wall between chambers 16 and 18. Design principles well known to the art may be employed to set the pressure differential at an appropriate magnitude. In addition to providing the required pressure drop, apertures 28 may induce a nozzle effect thereby increasing the velocity of air flow through chamber 18. Finally, the plurality of apertures 28 further provide a means for uniformly and evenly distributing the rate and amount of air flow between chamber 16 to chamber 18 across the linear extent 30 of hood 10 as thus shown in FIG. 2.

The bottom portion of chamber 18 is provided with a plate 32 which is fixed at its ends 34 as shown in FIG. 3. Plate 32 has at least one slot defined therein and in the embodiment illustrated, is shown as having two slots. A first slot 36 is shown as being formed at the lower portion of plate 32 next to an inlet port 40 of exhaust duct 20. A second slot 38 is shown as being formed at the opposing end of plate 32 and substantially positioned over the cooking line corresponding to grill 14. The cooking line is defined as the general region next to cooking surface 12 wherein personnel will normally be stationed. In addition, the cooking line is the general area beyond which it is undesirable to have any effects of smoke, grease or vapor.

Figure 4:
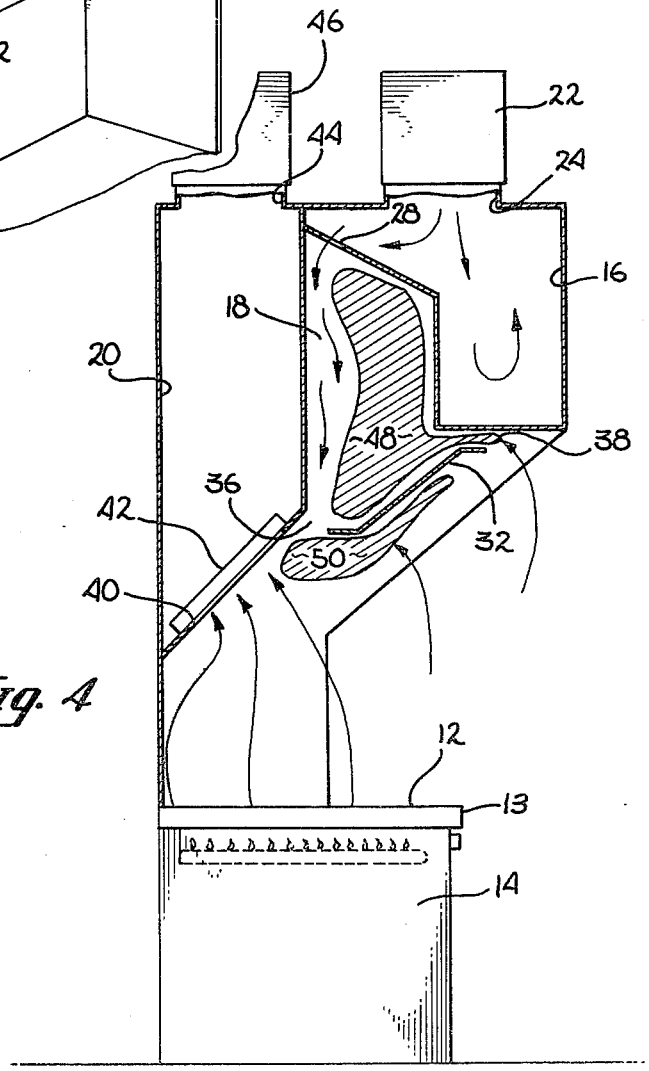
FIG. 4 is a cross sectional side view taken through the section as shown in FIG. 3 wherein the areas of partial pressure and air flow have been diagramatically illustrated.

In the embodiment illustrated, slots 36 and 38 are venturi slots. In other words, the dimension of slots 36 and 38 are chosen with respect to the flow within the given hood such that sufficient velocity is obtained by the air being emitted through slots 36 and 38 that regions of low pressure are generated in the contiguous areas. Inlet port 40 is shown in FIGS. 3 and 4, as having disposed thereover a grease filter 42. Any filter type well known to the art may be employed, however, it must be understood that the resistance to air flow of filter 42 will affect the dynamic performance of the overall system. Therefore, the location and magnitude of low pressure regions formed within or exterior to partial pressure chamber 18 may be affected in part by the resistance to air flow of filter 42. The proper air resistances may be chosen by empirical design by the use of well known principles. Air forced or drawn into exhaust duct 20 through filter 42 then moves upward through an outlet port 44 into appropriate ductwork or conduit 46. Ductwork 46 is coupled to a sink for air which typically may include an exhaust fan which has an outlet communicating with the environment. Thus, the air flow of hood 10 may be accomplished by forced air through ductwork 22 into supply plenum 16 and drawn or evacuated air through exhaust 20 and ductwork 46. Clearly, the quantities of air flow, and the velocities of air flow will be determined by the capacity of the exhaust and supply fans, the length of run and resistance to flow of ductwork 22 and 46 as well as the geometrical parameters of plenum 16 and exhaust duct 20.

The operation of the present invention may now be understood in connection with FIG. 4. Make-up air provided through apertures 28 enters chamber 18 at an increased flow and tend to move downwardly along the rear wall of chamber 18 towards slot 36. A certain amount of air will also be directed through slot 38. By virtue of the increased velocity of air with respect to the surrounding areas, regions of partial or lower pressure are developed within chamber 18 and exterior to chamber 18. For example, an interior region 48 is diagramatically illustrated in FIG. 4 as is an exterior region 50. By virtue of low pressure regions 48 and 50, smoke, grease and vapor generated from cooking surface 12 rise by means of natural convection with the aid of the pressure differential which is constantly maintained by venturi slots 36, 38 and chamber 18. Although some entrainment of the space conditioned air is unavoidable, the drawing power of hood 18 is substantially due to the partial pressure regions 48 and 50 and is not dependent upon an entrainment mechanism. Thus, even for substantial amounts of smoke, grease and vapor, a hood can be devised to evacuate the contaminated air without necessarily entraining correspondingly large quantities of the space conditioned air with the resultant net savings in energy costs. Although the present invention has been described in connection with a specific embodiment as shown in FIGS. 1 through 4, it is to be kept in mind that the embodiment is shown only for the purposes of illustration and clarity and is not to be taken to limit or restrict the scope of the present invention.

I claim:

1. An apparatus comprising:

a supply plenum coupled to a source of air;

a partial pressure chamber communicating with said supply plenum through at least a first venturi means defined in a wall therebetween for forming a low pressure region in part of said partial pressure chamber; and an exhaust duct coupled to a sink of air in communication with said partial pressure chamber through at least one aperture in the wall of said partial pressure chamber, whereby the rate of exhaust air quantities within said apparatus and the amount of air drawn into said apparatus from the surrounding conditioned space is decreased, thus saving energy.

2. The apparatus of claim 1 wherein said exhaust duct has an inlet port disposed in the proximity of a second venturi means defined in a wall of said partial pressure chamber opposing said first venturi means to provide a substantially unimpeded flow of air therebetween to maintain said low pressure region in said part of said partial pressure chamber.

3. An apparatus for use above a cooking surface having a cooking line at one edge of said cooking surface, access being provided to said cooking surface across said cooking line, comprising:

a supply plenum coupled to a source of air;

a partial pressure chamber communicating with said supply plenum through at least a first venturi slot defined in a wall therebetween to form a low pressure region in part of said partial pressure chamber; and an exhaust duct coupled to a sink of air in communication with said partial pressure chamber, said exhaust duct having an inlet port disposed in the proximity of a second venturi slot defined in a wall of said partial pressure chamber opposing said first venturi slot, wherein said partial pressure chamber has defined therein a third slot, said third slot disposed in a wall disposed above said cooking line whereby the rate of exhaust air quantities within said apparatus and the amount of air drawn into said apparatus from the surrounding conditioned space is decreased, thus saving energy.

4. The apparatus of claim 3 wherein said third slot is disposed above said second venturi slot, and said second venturi slot is further from said cooking line than said third slot.

5. The apparatus of claim 4 wherein said first venturi slot is a plurality of apertures linearly arranged and disposed in a substantially overlying relationship with respect to said second venturi slot to form a region of partial pressure within said partial pressure chamber and exterior to said partial pressure chamber in a region between said third slot and second venturi slot.

6. An exhaust hood for use over a cooking surface having a cooking line at one edge of said cooking surface, access being provided to said cooking surface across said cooking line, comprising:

a supply plenum coupled to a source of air;

an exhaust duct coupled to a sink of air and having an inlet port; and a partial pressure chamber communicating with said supply plenum through a plurality of venturi apertures oppositely disposed to a first venturi slot defined in a lower one of the walls of said partial pressure chamber, said first venturi slot juxtapositioned next to said inlet port of said exhaust duct, a second slot also being defined in one of the lower walls of said partial pressure chamber and being disposed over said cooking line said first venturi slot being more distal from said cooking line than said second slot.

* * * * *